United States Patent [19]

Beard

[11] Patent Number: 4,656,669

[45] Date of Patent: Apr. 14, 1987

[54] VERSATILE BATHING SUIT

[76] Inventor: Donna Beard, 25 Marmora Rd., Parsippany, N.J. 07054

[21] Appl. No.: 880,588

[22] Filed: Jun. 30, 1986

[51] Int. Cl.[4] ..... A41D 5/00

[52] U.S. Cl. ..... 2/67

[58] Field of Search ..... 2/67, 88

[56] References Cited

U.S. PATENT DOCUMENTS 4,227,264 10/1980 Spector et al. ..... 2/84

4,301,545 11/1981 Camarena ..... 2/67

FOREIGN PATENT DOCUMENTS 1154991 11/1957 France ..... 2/67

1440786 6/1976 United Kingdom ..... 2/67

*Primary Examiner*—Doris L. Troutman

*Attorney, Agent, or Firm*—Robert S. Salzman

[57] ABSTRACT

The invention comprises a two-piece bathing suit having a hidden pocket in a panty section. The pocket can contain additional bathing suit materials for creating an ensemble effect, or for changing the appearance of the bathing suit from a two-piece to a one-piece look.

16 Claims, 5 Drawing Figures

VERSATILE BATHING SUIT

FIELD OF THE INVENTION

The invention features a two-piece bathing suit having a hidden pouch or pocket within the panty portion of the bathing suit for containing additional bathing suit materials for complementing the bathing suit and for creating a portable ensemble capability.

BACKGROUND OF THE INVENTION

Many bathing suits have the versatility of being transformed to an ensemble by the addition of additional matching garment pieces, such as wraps or capes. One such teaching is shown in U.S. Pat. No. 2,060,689; issued: Nov. 10, 1936.

The additional matching pieces require that they be brought to the bathing area as separate clothing items, thus requiring additional care and storage.

In U.S. Pat. No. 4,301,545; issued: Nov. 24, 1981, a bathing suit is illustrated that has an additional flap sewn into the panty section. The flap is used to cover a portion of the abdomen of the female user, in order to conceal surgery scars and other blemishes.

The sewn-in materials provide only a single appearance to this bathing suit, i.e. the bathing suit does not have the capability and versatility of changing its look or function.

The invention seeks to provide a bathing suit having the capability of changing both its appearance and function to provide an ensemble look, and/or a change from a two-piece to a single piece appearance.

The invention accomplishes the above-advantages by the utilization of a hidden pouch or pocket that is disposed within the lining of the panty section. The hidden pocket of the bathing suit of this invention can contain one or more add-on pieces to generate a versatile ensemble, wherein the appearance and function of the suit may be changed several times during the day.

For example, the hidden pocket can contain a cape section; and frontal coverings with and without cut-out designs.

The additional materials can be the same color or a matching color as the bathing suit.

The additional pieces are made having thin textile weight, so they will not present a bulky profile within the hidden pouch.

The added materials can be attached to the bathing suit by male and female fasteners disposed underneath the bra or panty sections of the bathing suit.

BRIEF DESCRIPTION OF THE INVENTION

The invention features a two-piece bathing suit having an upper bra section and a lower panty section. The panty section comprises at least one pouch disposed in an internal area of the panty. The pouch can contain various bathing suit materials for complementing the bathing suit ensemble. One such material is a frontal piece for covering the abdomen. This piece attaches underneath the bra and panty sections, and effectively converts the two-piece appearance into a one-piece look.

The pouch can also contain a cape or shawl for covering the shoulders of the wearer. The cape would be a fashion accessory as well as a means to keep the bather warm and dry.

Both the cape and frontal covering can come in many designs, colors, thus enhancing the wardrobe capabilities of the single bathing suit, i.e. many different appearances are possible with the same suit.

It is an object of this invention to provide a bathing suit having an enhanced versatility that contemplates many different ensemble creations.

It is also an object of the invention to provide a bathing suit that can be converted easily from a two-piece appearance to a single-piece look.

DETAILED DESCRIPTION OF THE INVENTION

Generally speaking, the invention features a two-piece bathing suit that comprises at least one hidden pocket for containing additional bathing suit materials for providing an ensemble capability.

Figure 1:
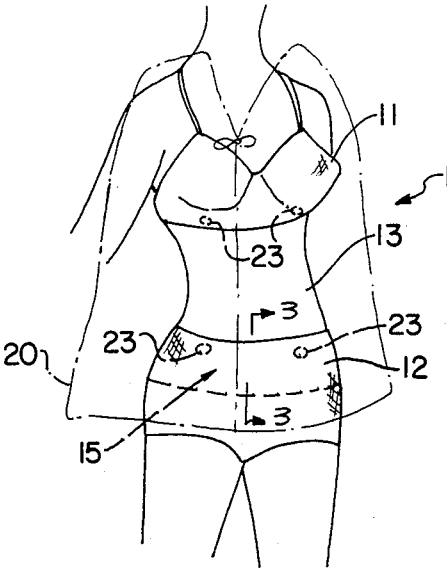
FIG. 1 is an in situ, front view of the bathing suit of this invention, with a shawl shown in phantom.
Figure 2:
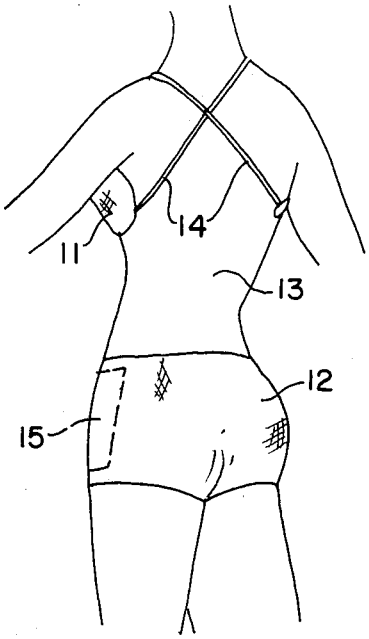
FIG. 2 is an in situ, rear view of the invention shown in FIG. 1.

Referring now to FIGS. 1 and 2 a bathing suit 10 is illustrated by front and back views.

The bathing suit 10 comprises an upper bra section 11 and a lower panty section 12. These sections are shown in situ, i.e. as worn upon the torso 13 of the wearer.

The bra section 11 is generally secured by means of crossover straps 14, as depicted in FIG. 2.

The panty section 12 can be secured to the torso by a sewn-in elastic band (not shown), or a similar means known in this art.

Figure 3:
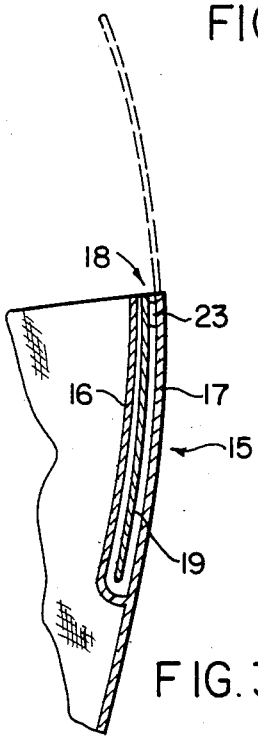
FIG. 3 is a sectional view of FIG. 2 take along lines 3—3, showing the internal pouch with material disposed inside.

The panty section 12 has an internal pocket 15, which is shown in greater detail in the sectional view of FIG. 3. The pocket 15 comprises a patch of material 16 that is sewn to the front portion 17 of the panty section 12.

Other such pockets can be sewn into the panty section 12, as desired.

The pocket 15 has an opening 18 at the top by which other bathing suit materials 19 may be inserted or removed.

One such additional bathing suit material 19 can comprise a cape or shawl 20, as shown in phantom view in FIG. 1. The cape 20 creates an ensemble appearance for the bathing suit 10.

Figure 4:
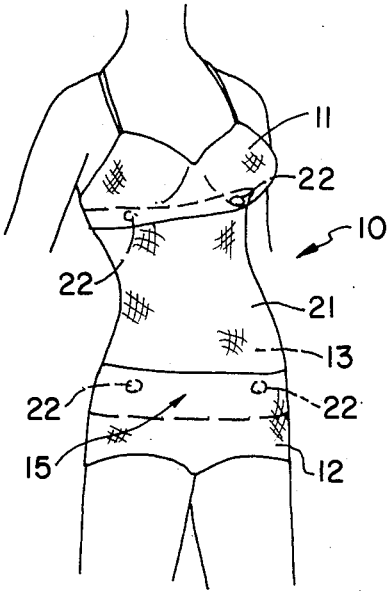
FIG. 4 is a front view of the bathing suit of FIG. 1 having a front covering piece attached between the bra and panty sections.

The additional material 19 may also be a frontal cover piece 21, as illustrated in FIG. 4. The cover piece 21 attaches to the bra section 11 and panty section 12, which produces a one-piece look to the bathing suit 10.

Figure 5:
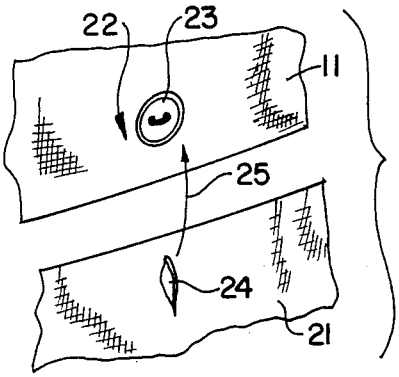
FIG. 5 is an enlarged partial view of one of the button fasteners utilized to attach the front covering piece of FIG. 4.

The cover piece 21 can be solid, as shown in FIG. 4, or may have cut-outs for purposes of styling. The frontal cover piece 21 may also wrap around the back, if so desired. Piece 21 is attached underneath the bra and panty sections 11 and 12, respectively, by means of male and female fasteners 22. Fasteners 22 may also extend around the rear portion of the pantry section 12, where the cover piece 21 extends around the back of bathing suit 10. The male and female fasteners 22 may be snap fasteners, Velcro® tabs or strips, or the conventional button 23 and button-hole 24 (typical), as shown in FIG. 5.

Cover piece 21 (FIG. 5) shown in partial view, is buttoned underneath the bra section 11 (arrow 25), as illustrated.

The pocket 15 contains one or more buttons 23, as depicted in FIGS. 1 and 3. The cover piece 21 will contain corresponding button-holes 24 to match and align with the buttons 23.

The materials 19 can be any matching or contrasting textile or color with respect to basic bathing suit 10. Materials 19 are preferably made thin, so that they do not produce a bulky appearance within pocket 15.

The conventional button 23 and button-hole 24 can also be replaced or substituted with zippers, as a means for securing the various add-on pieces, pockets, etc.

Having thus described the invention, what is desired to be protected by Letters Patent is subsequently presented by the appended claims.

What is claimed is:

1. In a bathing suit comprising a multiple-piece ensemble having a matching cape and an upper portion and a lower portion which are to be worn about the torso, said upper portion including a bra section, and said lower portion including a panty section, comprising means defining at least one pouch disposed within said panty section, said pouch having an inner lining and being generally disposed about an internal area of said panty section for the purpose of containing at least two additional bathing suit materials for complementing said ensemble, one of said additional materials being removably attachable to said inner lining by a fastening means and additionally fastenable to said bra section.

2. The bathing suit of claim 1, wherein one of said additional bathing suit materials comprises a frontal bathing suit piece for covering the abdomen portion and sides of said torso, for the purpose of providing a one-piece bathing suit appearance.

3. The bathing suit of claim 2, wherein said frontal bathing suit piece comprises means for attachment to said bra section.

4. The bathing suit of claim 3, wherein said attachment means includes at least one button-hole, said bra section further including at least one button for placement into said button-hole, whereby said frontal bathing suit piece is secured between said upper and lower portions.

5. The bathing suit of claim 3, wherein said attachment means is disposed underneath said bra section.

6. The bathing suit of claim 3, wherein said attachment means comprises male and female fastening means.

7. The bathing suit of claim 6, wherein said male and female fastening means includes Velcro-type materials.

8. The bathing suit of claim 3, wherein said frontal bathing suit piece comprises a matching cape section.

9. A bathing suit capable of providing an alternative fashion design, wherein said bathing suit can provide either a one or two-piece bathing suit appearance, and an ensemble look provided by an additional matching cape worn over a shoulder portion, said bathing suit comprising a bra section for an upper torso body portion, and a panty section for a lower torso body portion, said panty section having an inner lining and at least one additional bathing suit piece including said cape disposed in a hidden pocket of said panty section for converting said bathing suit into an ensemble with a cape and a one-piece bathing suit appearance, said additional bathing suit piece covering the abdomen and sides of said torso and removably attachable to said inner lining of said panty section by fastener means and similarly removably attachable to said bra section.

10. The bathing suit of claim 9, wherein said hidden piece comprises a frontal covering that is disposed within an internal sewn pocket of said panty section.

11. The bathing suit of claim 10, wherein said frontal covering is removably attachable to said bra section by two buttons.

12. The bathing suit of claim 11, wherein said frontal covering is attached to said bra section by means of a male and female connection.

13. The bathing suit of claim 12, wherein said male and female connection comprises at least one button and corresponding button-hole.

14. The bathing suit of claim 12, wherein said male and female connection comprises at least one snap fastener.

15. The bathing suit of claim 12, wherein said male and female connection comprises a Velcro-type material.

16. The bathing suit of claim 11, wherein said frontal covering is disposably attached underneath said bra section.

* * * * *